US007110707B2

(12) United States Patent
Nishitani

(10) Patent No.: US 7,110,707 B2
(45) Date of Patent: Sep. 19, 2006

(54) TONER SUPPLYING APPARATUS AND IMAGE FORMING APPARATUS

(75) Inventor: Hitoshi Nishitani, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 10/847,456

(22) Filed: May 18, 2004

(65) Prior Publication Data

US 2005/0002700 A1 Jan. 6, 2005

(30) Foreign Application Priority Data

May 21, 2003 (JP) ..... 2003-143592

(51) Int. Cl.
*G03G 15/08* (2006.01)

(52) U.S. Cl. ..... 399/258; 399/262

(58) Field of Classification Search ..... 399/258, 399/260, 262, 263

See application file for complete search history.

(56) References Cited

U.S. PATENT DOCUMENTS

| | | | | |
|---|---|---|---|---|
| 4,496,644 | A | 1/1985 | Ateya et al. | 430/122 |
| 5,126,799 | A * | 6/1992 | Matsuura et al. | 399/262 X |
| 5,621,507 | A * | 4/1997 | Nishimura et al. | 399/262 X |
| 6,334,037 | B1 | 12/2001 | Ise | 399/262 |
| 6,556,801 | B1 * | 4/2003 | Shimaoka et al. | 399/258 |
| 6,597,882 | B1 * | 7/2003 | Tanaka | 399/258 |
| 6,795,660 | B1 * | 9/2004 | Yugeta et al. | 399/258 X |
| 2004/0076452 | A1 | 4/2004 | Nishitani et al. | 399/254 |

FOREIGN PATENT DOCUMENTS

| | | |
|---|---|---|
| EP | 1 120 691 A2 | 8/2001 |
| EP | 1 225 487 A2 | 7/2002 |
| EP | 1 229 402 A2 | 8/2002 |
| JP | 55-32060 | 3/1980 |
| JP | 59-165082 | 9/1984 |

* cited by examiner

*Primary Examiner*—Sandra L. Brase
(74) *Attorney, Agent, or Firm*—Fitzpatrick, Cella, Harper & Scinto

(57) ABSTRACT

A toner supply apparatus includes a first toner container; a first feeding member for feeding toner in the first toner container; a second toner container for receiving the toner from the first toner container; a second feeding member for feeding toner in the second toner container; a third toner container, detachably mountable relative to a main assembly of the toner supply apparatus, for receiving in the toner from the second toner container; wherein when the toner is supplied into the third toner container, the first feeding member is driven in accordance with a toner supply amount, and the second feeding member is substantially continuously driven irrespective of the toner supply amount.

6 Claims, 7 Drawing Sheets

TONER SUPPLYING APPARATUS AND IMAGE FORMING APPARATUS

FIELD OF THE INVENTION AND RELATED ART

The present invention relates to a toner supplying apparatus employed by a copying machine, a printer, a facsimileing machine, etc., which form an image with the use of an electrophotographic or electrostatic recording method. It also relates to an image forming apparatus.

As the developing method employed by such an image forming apparatus as the abovementioned ones, the following method has been known: Dry developer as developing agent is borne on the peripheral surface of a developer bearing member (developing means), and is delivered by the developer bearing member to the immediate adjacencies of the peripheral surface of an image bearing member, which is bearing an electrostatic latent image, so that as alternating voltage is generated between the image bearing member and developer bearing member, the electrostatic latent image is developed into a visible image. It has been a common practice to use a development sleeve and a photosensitive drum as the developer bearing member and image bearing member, respectively.

As for the developing means, the so-called magnetic brush type developing method has been known. According to this method, a development sleeve and a photosensitive drum are positioned so that there is a minute gap between their peripheral surfaces, and a magnetic brush is formed of two-component developer (primary components of which are particulate carrier and particulate toner), on the peripheral surface of a development sleeve which internally holds a magnet, and so that the tip of the magnetic brush rubs, or virtually rubs, the peripheral surface of the photosensitive drum. Then, alternating electric field is continuously generated across the gap (S-D gap) between the development sleeve and photosensitive drum so that the latent image on the peripheral surface of the photosensitive drum is developed while the toner particles oscillate between the development sleeve and photosensitive drum (for example, Japanese Laid-open Patent Applications 55-32060, and 59-165082).

Next, the structure of a developing apparatus employing one of the two-component magnetic brush based developing methods will be described. Referring to FIG. 5 which is a sectional view of an example of a developing apparatus of this type, at a plane perpendicular to the lengthwise direction thereof, the developing apparatus 100 comprises: a development sleeve 101 as a developer bearing member used for developing an electrostatic image formed on an image bearing member; a magnetic roller 102 as a magnetic field generating means stationarily placed in the hollow of the development sleeve 101; a development screw 103 and a stirring screw 104 as means for conveying the developer in the developing apparatus 100 to the development sleeve 101 while stirring it; developing means container 105 comprising a toner reception hole 105*a*, a development chamber 105*b*, and a stirring chamber 105*c*; and a regulation blade 106 as a developer regulating member provided for forming a thin uniform layer of developer on the peripheral surface of the development sleeve 101. Located on top of the developing apparatus 100 is a toner container 200 as a container for holding the toner supply for the developing apparatus 100. The toner container 200 is connected to the abovementioned toner reception hole 105*a* of the developing apparatus 100. The toner container 200 is provided with a toner conveyance screw 205 as a conveying means for delivering toner from the toner container 200 to the developing apparatus 100. As will be evident from the drawing, the development sleeve 101 is positioned very close to the photosensitive drum 111 as an image bearing member to be developed, and is rotated in the direction opposite to, or the same as, the rotational direction of the photosensitive drum 111, so that the latent image on the peripheral surface of the photosensitive drum 111 is developed by the developer (represented by dots) in the magnetic brush, which is in contact with the peripheral surface of the photosensitive drum 111.

The developing means container 105 contains developer (two-component developer), which primarily is a mixture of particulate toner and particulate magnetic carrier. As the toner in the developing means container 105 is consumed by development, the toner supply in the toner container 200 is conveyed from the toner container 200 to the developing means container 105 by the toner conveyance screw 205, by the amount matching the amount of the toner consumed by development. As the toner is delivered to the toner reception hole 105*a* of the developing means container 105, it falls through the hole 105*a* into the stirring chamber 105*c* having the stirring screw 104.

Thus, the ratio of particulate toner to magnetic carrier (which hereinafter will be referred to as "T/C ratio") remains constant. As for the method for detecting the T/C ratio in the developing means container 105 and maintaining it at a predetermined value, various methods have been proposed, and some of them have been put to practical use.

For example, according to one of such methods, a T/C ratio detecting means is placed in the adjacencies of the photosensitive drum 111, and a beam of light is projected onto the layer of the toner having transferred from the development sleeve 101 onto the photosensitive drum 111. Then, the amount by which toner is supplied is adjusted from the amount of the transmitted light and the amount of the reflected light, in order to maintain the T/C ratio at a predetermined level. According to another method, a detecting means is placed on the development sleeve 101, and the T/C ratio is deduced from the amount of the light reflected when a beam of light is projected onto the layer of developer on the development sleeve 101. According to another method, a sensor is located within the developing means container 105, and the changes in the apparent permeability $\mu$ of the body of developer, with a predetermined volume, in the adjacencies of the sensor are detected based on the inductance of a coil in order to detect the T/C ratio. Then, the T/C ratio is deduced from the detected changes.

In the case if the above-described method in which a toner content detection sensor based on the changes in the permeability of a body of developer with a predetermined volume, the increase in permeability means the decrease in the T/C ratio of the body of developer with a predetermined volume, in other words, the decrease in the toner content in the developer. Thus, as the permeability increases beyond a preset value, the toner supplying operation is started. On the other hand, the decrease in the permeability means the increase in the T/C ratio in the body of developer with a predetermined volume, in other words, the increase in the toner content in the developer. Thus, as the permeability decreases below a preset value, the toner supplying operation is stopped. In other words, the T/C ratio is controlled by alternately repeating the above-described sequences.

Referring to FIG. 6 which is a plan view of the developing apparatus 100, the development sleeve 101, development screw 103, and stirring screw 104 are rotationally driven by the force transmitted from a driving force source (unshown) such as a motor through a driving force transmitting means (unshown) such as a gear train. As the development screw 103 and stirring screw 104 are rotated in a predetermined direction at a predetermined speed, the developer in the developing means container 105 is circulated therein in the direction indicated by an arrow mark. In other words, as the fresh supply of toner is delivered through the toner reception hole 105*a*, it is conveyed through the stirring chamber 105*b*, while being evenly distributed in the developer and being thoroughly charged by friction. Then, it is delivered to the development chamber 105*b*. In the development chamber 105*b*, a magnetic brush is formed of the developer, on the peripheral surface of the development sleeve 101 by the development magnetic field generated by the magnetic roller 102 in the hollow of the development sleeve 101, and the toner particles adhering to the magnetic brush and the toner particles adhering to the peripheral surface of the development sleeve 101 transfer onto the area of the peripheral surface of the photosensitive drum 111 bearing the electrostatic latent image, developing thereby the image.

Next, referring to FIG. 7 which is a sectional view of a typical toner supplying apparatus 300 in accordance with the prior art, at a vertical plane which is parallel with the lengthwise direction of the developing apparatus 100, the toner supplying apparatus 300 comprises: a toner container 200 as a toner supply container comprising a main chamber 201 and a buffer chamber 202; a pipe 203 as a toner conveyance passage; a toner discharge hole 204 (toner drop hole); a toner conveyance screw 205 as a toner conveying member; a driving means 206 for rotationally driving the toner conveyance screw 205; a drive controlling means 207 for controlling the driving or stopping of the driving means 206; a toner supply amount computing means 214 which determines the amount by which toner is to be supplied to the developing apparatus 100, based on the programs and data stored in a storage device 215, and outputs to the drive controlling means 207, the number of rotations or length of time necessary for the toner conveyance screw 205 to be rotated to deliver toner by the determined amount; and a developing apparatus 100 (developing means container 105) as a toner receiver, which catches the toner discharged downward from the pipe 203.

The developing apparatus 100 is removably attached to the image forming apparatus main assembly, being enabled to move relative to the main assembly of the toner supplying apparatus 300. More specifically, the toner reception hole 105*a* of the developing apparatus 100 is connected to the abovementioned toner discharge hole 204 of the toner container 200. Among the above listed structural components, only the developing apparatus 100 is an replaceable component (exchangeable unit) that can be removably mountable in the main assembly of an image forming apparatus, being enabled to be removably connected to the toner supplying apparatus. The other components are non-replaceable structural components of the apparatus main assembly.

The main chamber 201 of the toner container 200 stores the toner filled therein by a user or such an operator as the maintenance person of the apparatus. The main chamber 201 contains a stirring member (unshown), which sends toner to the buffer chamber 202, as necessary, while stirring the toner to prevent the toner from agglomerating. The bottom end of the buffer chamber 202 is connected to the pipe 203, which is provided with the toner discharge outlet 204, which is located near the tip of the pipe 203, extending vertically downward, and through which the toner is allowed to fall.

Within the pipe 203, the toner conveyance screw 205, which comprises a rotational shaft and a spiral flange attached to the rotational shaft, is rotatably supported. As the toner conveyance screw 205 is rotated, the toner in the pipe 203 is advanced in the direction in which the rotating spiral flange appears to advance as it is rotated. More specifically, the toner conveyance screw 205 is rotated or stopped by controlling the driving means 206 with the use of the drive controlling means 207. As the toner reaches the toner discharge hole 204, it falls through the toner discharge hole 204 due to its own weight, into the developing apparatus 100 through the toner reception hole 105*a*; the developing apparatus 100 is supplied with toner.

The toner supply amount computing means 214 determines the amount by which toner is to be supplied to the developing apparatus 100, based on the values of the outputs of the sensor for detecting the ratio of the toner in the developer, and data such as print density and cumulative amount of the supplied toner, stored in the storage device 215. Based on the determined amount, the toner amount computing means 214 outputs to the drive controlling means 207, the number of times, or length of time, the toner conveyance screw 205 needs to be rotated. As a result, the toner conveyance screw 205 is rotationally driven the necessary number of times, or length of time, conveying thereby the toner to supply the developing apparatus 100 with the toner.

The number of times, or length of time, the toner conveyance screw 205 is to be rotated is determined based on the amount determined by the toner supply amount computing means 214. As the toner conveyance screw 205 it is rotated the necessary number of times, or length of time, it is stopped so that the toner is supplied only by the necessary amount to the developing apparatus 100 through the toner discharge hole 204.

The amount by which toner is conveyed by the toner conveyance screw 205 per rotation of the toner conveyance screw 205, or per unit of time, is numerated and stored in the storage device 215, so that it can be read as necessary by the toner supply amount computing means 214 to compute the number of times, or length of time, the toner conveyance screw 205 is to be rotated. Incidentally, the amount by which toner is conveyed by the toner conveyance screw 205 is roughly proportional to the number of the rotations of the toner conveyance screw 205. Therefore, when controlling the amount by which toner is conveyed by the toner conveyance screw 205, by controlling the length of time the toner conveyance screw 205 is rotated, it is mandatory that the means for rotationally driving the toner conveyance screw 205 is capable of rotating the toner conveyance screw 205 at a constant speed. However, if a means for counting the rotations of toner conveyance screw 205 is provided, the amount by which toner is conveyed can be controlled based on the number of the rotations of the toner conveyance screw 205 even if the rotational speed of the toner conveyance screw 205 is not constant.

The location of the toner reception hole 105*a* of the developing apparatus 100 in terms of the lengthwise direction of the developing apparatus 100 is chosen so that the received toner is sufficiently stirred and mixed with the developer in the developing apparatus 100, and also so that the received toner is thoroughly charged. More specifically, moving the toner reception hole 105*a* too far in the direction indicated by an arrow mark A causes the problem that the uncharged toner back-flows toward the development chamber 105*b*. On the other hand, moving the toner reception hole 105*a* too far in the direction indicated by an arrow mark B creates the problem that the toner fails to be sufficiently charged by the time it reaches the development chamber 105*b*. Thus, the toner reception hole 105*a* must be located within the limited range in terms of the developing apparatus 100, making it therefore necessary for the toner reception hole 105*a* to be located a certain distance away from the buffer chamber 202 of the toner container 200 in the horizontal direction. This is why the toner conveyance screw 205 is given the function of horizontally conveying toner from the buffer chamber 202 of the toner container 200 to the toner reception hole 105*a* of the developing apparatus 100.

As described above, according to the prior art, the toner conveyance screw 205 as a toner conveying member is given two functions: the function of precisely controlling the amount by which toner is supplied, by its rotation, and the function of horizontally conveying toner to the toner reception hole 105*a* of the developing apparatus 100.

In other words, according to the prior art, toner is conveyed and let fall through the toner discharge hole 204, by rotating the toner conveyance screw 205 the number of times proportional to the amount of the toner required by the developing apparatus 100. Thus, immediately after the rotation of the toner conveyance screw 205 is stopped, toner is present immediately next to the toner discharge hole 204 (point X in FIG. 7). Therefore, as soon as the rotation of the toner conveyance screw 205 is started, toner begins to fall. Thus, the amount by which toner is conveyed is virtually proportional to the number of the rotations of the toner conveyance screw 205, making it possible to precisely control the amount by which the developing apparatus 100 is supplied with toner.

However, in the case of this structural arrangement, when mounting or dismounting the developing apparatus 100, which is a unit removably mountable in the main assembly of an image forming apparatus, a small amount of toner falls due to vibrations, no matter how small the vibrations are. Therefore, both the toner outlet 204 of the toner supply container 200 and the toner reception hole 105*a* has to be provided with a complicated shutter mechanism.

Obviously, it is extremely difficult to perfectly prevent toner from scattering, by the provision of the shutters. That is, in the case of the toner supplying apparatus in accordance with the prior art, in which toner is present immediately next to the toner discharge hole 204, through which toner is supplied to the developing apparatus 100, the provision of the shutter mechanisms is mandatory. However, even if these shutter mechanisms are provided, it is impossible to avoid the problem that a small amount of toner scatters during the mounting or dismounting of the developing apparatus 100. This scattering of toner has been one of the essential causes of the soiling of the operator's hands, dirtying of the surroundings, and/or degradation of the image forming apparatus.

Also in the case of this structural arrangement, it is possible that when the toner conveyance screw 205 is rotated for only a short length of time to supply the developing apparatus 100 with toner, the amount by which toner is supplied does not become stable, causing thereby the toner content (toner ratio) in the stirring chamber 105*c* to become extremely high in certain areas.

As long as developer reaches the development chamber 105*b* after it became uniform in toner content in the stirring chamber 105*c*, there will be no problem. However, if the mixture of the freshly supplied toner and the developer which was in the stirring chamber 105*c* fails to be sufficiently stirred, and reaches the development chamber 105*b* before it becomes uniform in toner content, an image which is not uniform in density is formed. In order to solve this problem that the mixture of the fresh supply of toner and the developer which was in the developing apparatus 100 fails to be sufficiently stirred, and therefore, fails to become uniform in toner content, it is important that toner is supplied at a lower rate, and a sufficient amount of time is provided for stirring the mixture, to minimize the nonuniformity of the developer in the stirring chamber 105*b* in terms of toner content. This solution, however, contradicts the effort for reducing the time necessary for image formation. In recent years, this contradiction has become one of the largest technical problems, because the desire to increase the speed of an image forming apparatus has become extremely strong in recent years.

SUMMARY OF THE INVENTION

The primary object of the present invention is to provide a toner supplying apparatus which does not scatter toner when mounting or dismounting an apparatus having a toner chamber (third chamber) into which toner is discharged from the toner supply container.

Another object of the present invention is to provide a toner supplying apparatus capable of preventing the toner content in a developing device from locally increasing to an extremely high level even if a large amount of toner is discharged from the first toner chamber of the toner supplying apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the toner supplying apparatuses in accordance with the present invention will be described in more detail with reference to the appended drawings.

Embodiment 1

Figure 1:
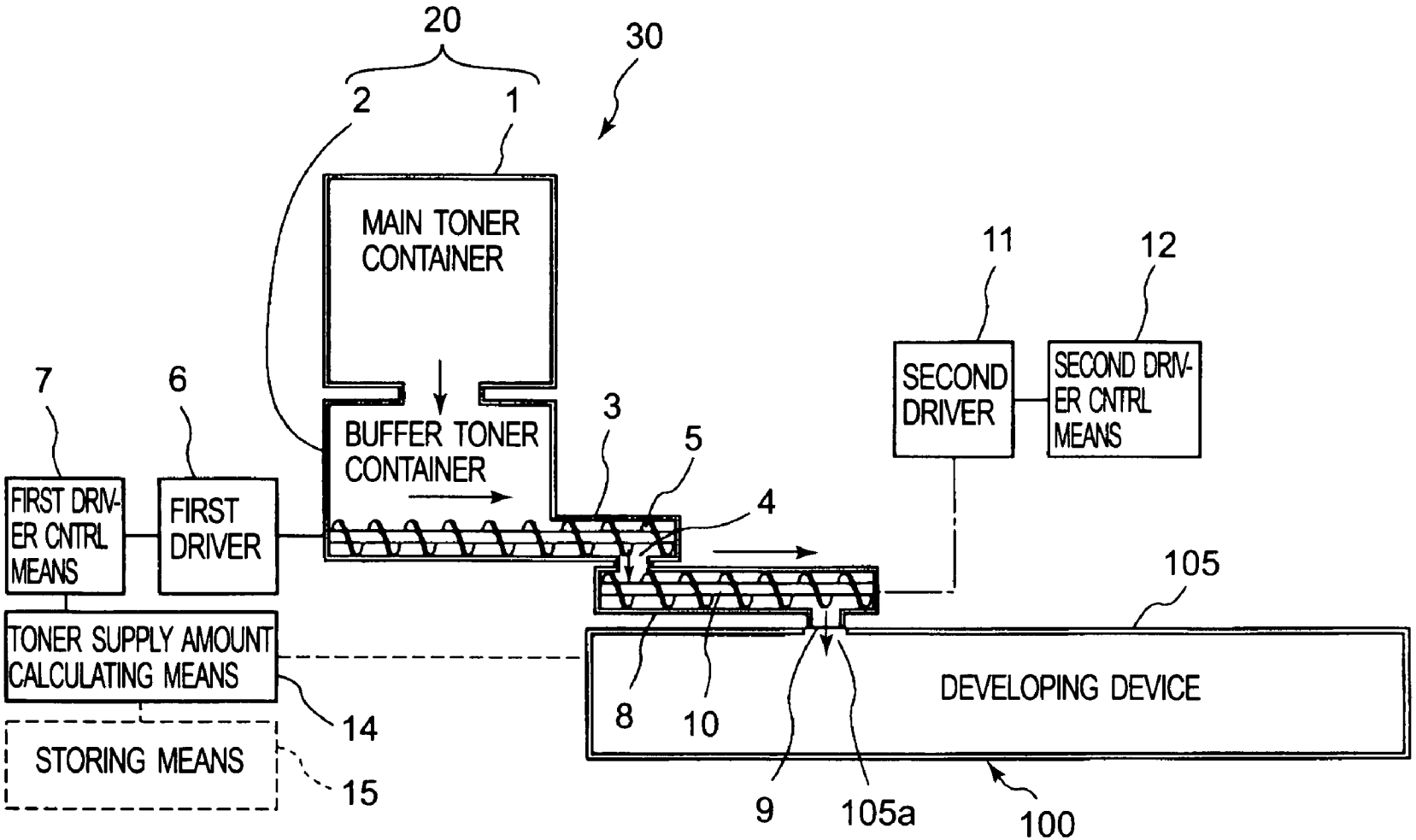
FIG. 1 is a schematic sectional view of the toner supply container in the first embodiment of the present invention.

Referring to FIG. 1, a typical image forming apparatus which employs a toner supplying apparatus in accordance with the present invention, will be described regarding its general structure. In this embodiment, the present invention is embodied in the form a toner supplying apparatus employable by such an image forming apparatus as an electrophotographic copying machine, a laser printer, a facsimile machine, etc. However, this embodiment is not intended to limit the scope of the present invention in terms of the apparatus to which the present invention is applicable. It should be understood that the present invention is applicable to a wide range of electrophotographic and electrostatic image forming apparatuses.

The image forming apparatus 110 has an electrophotographic photosensitive member 111 (photosensitive drum) as an image bearing member in the form of a rotational drum. The photosensitive drum 111 is rotated in the direction indicated by an arrow mark while being uniformly charged by a primary charging device 112 as a charging means. Thereafter, the charged area of the peripheral surface of the photosensitive drum 111 is exposed to a beam of laser light projected from an exposing apparatus 113 (laser scanner) as an exposing means, while being oscillated in a manner to scan the charge area and being modulated with the image formation data signals for a desired image, sent from an external host apparatus such as an original reading apparatus, a personal computer, etc., connected to the main assembly of the image forming apparatus in a manner to allow two-way communication. As a result, an electrostatic latent image in accordance with the image formation data signals is formed on the peripheral surface of the photosensitive drum 111. This electrostatic latent image is developed in reverse (in this embodiment) by the developing apparatus 100, which uses two-component developer, that is, the mixture of particulate toner and particulate carrier, into a visible image (image formed of toner, which hereinafter will be referred to simply as toner image).

Then, the toner image on the peripheral surface of the photosensitive drum 111 is transferred by the function of a transfer charging device 114*a* as a transferring means, onto a transfer medium S held on a transfer medium conveying endless belt 114*b* as a transfer medium bearing member, which is suspended by a pair of rollers 114*c* and 114*d* and is circularly driven.

After the transfer of the toner image onto the transfer medium S, the transfer medium S is separated from the transfer medium conveying belt 114*b*, and is conveyed to an unshown fixing device, in which the toner image is permanently fixed to the transfer medium S. The residual toner, or the toner remaining on the photosensitive drum 111 after the transfer of the toner image therefrom, is removed by a cleaning means 115, which comprises a cleaning blade, or the like, placed in contact with the photosensitive drum 111.

Figure 3:
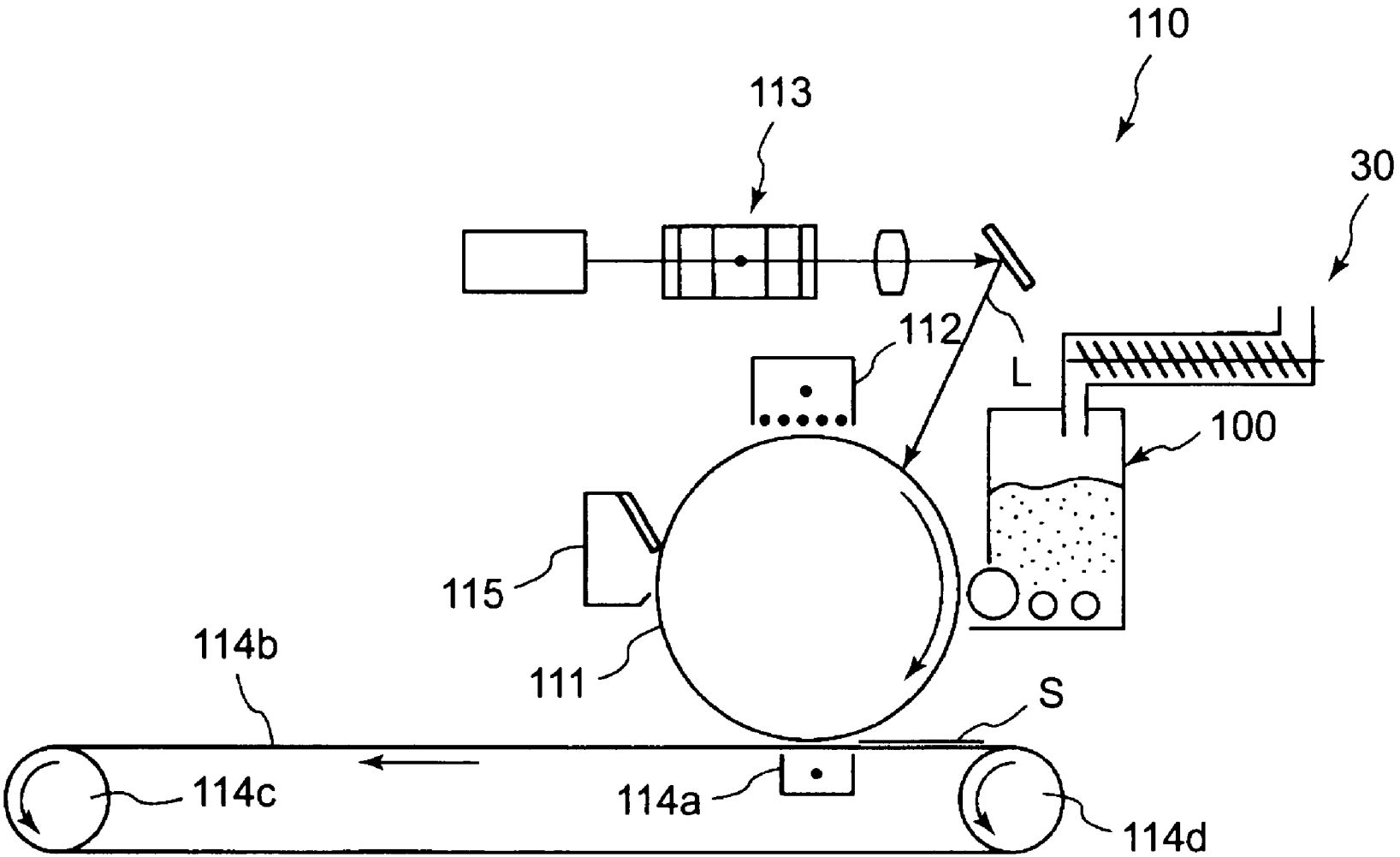
FIG. 3 is a schematic sectional view of a typical image forming apparatus in accordance with the present invention.

Incidentally, for the simplification of the description of the image forming apparatus, FIG. 3 shows only one of the image forming portions (each of which comprises: a photosensitive drum 111, a primary charging device 112, an exposing apparatus 113 emitting a laser beam L onto the photosensitive drum 111, a developing apparatus 100, etc.). However, in the case of a color image forming apparatus, multiple image forming portions matching, in number, various colors, for example, cyan, magenta, yellow, and black, are placed along the transfer medium conveying range of the transfer medium conveying belt 114*b*. In each image forming portion, an electrostatic image representing one of the color components obtained by separating in color the original, is formed on the photosensitive drum 111, and is developed by the corresponding developing apparatus which contains the toner corresponding in color to the color component. Then, the developed latent image, or the toner image, is transferred onto the transfer medium S being conveyed by the transfer medium conveying member 114*b*. This image formation process comprising the above described steps is carried out by all the image forming stations in synchronism with the movement of the transfer medium S. Thus, multiple toner images different in colors are sequentially transferred onto the transfer medium S. Incidentally, instead of employing the transferring member bearing member, one of the so-called intermediary transfer systems well known in the field of image formation may be used, which employs an intermediary transferring member (intermediary transfer belt, or the like). In such a case, the toner images formed in the multiple image forming portions, one for one, are sequentially and temporarily transferred in layers onto the intermediary transferring member, and then, are transferred all at once from the intermediary transferring member to the transfer medium S.

The developing apparatus 100 in this embodiment is not different from the above described one in accordance with the prior art. Next, the toner supplying apparatus 30 in this embodiment, which characterizes the present invention, will be described.

FIG. 1 is a sectional view of the toner supplying apparatus 30, at a plane parallel to the lengthwise direction of the developing apparatus 100. As will be evident from FIG. 1, the toner supplying apparatus 30 comprises: a toner supply container 20 comprising a main chamber 1 and a buffer chamber 2 ; a first pipe 3 (first toner chamber) as a first toner conveyance passage; a first toner discharge hole 4 (toner drop hole); a first toner conveyance screw 5 as a first toner conveying member; a first driving means 6 for rotationally driving the first toner conveyance screw 5; a first drive controlling means 7 for controlling the driving or stopping of the first driving means 6; a second pipe 8 (second toner chamber) as a second toner conveyance passage; a second toner discharge hole 9 (toner drop hole); a second toner conveyance screw 10 as a second toner conveying member; a second driving means 11 for rotationally driving the second toner conveyance screw 10; a second drive controlling means 12 for controlling the driving or stopping of the second driving means 11; a toner supply amount computing means 14 which determines the amount by which toner is to be supplied to the developing apparatus 100, based on the programs and data stored in a storage device 15, and outputs to the drive controlling means 7, the number of rotations or length of time necessary for the toner conveyance screw 5 to be rotated to deliver toner by the determined amount; and a developing apparatus 100 (developing means container 105) as a toner receiver, which catches the toner discharged downward through the second toner discharge hole 9 of the second pipe 8. Thus, the first driving means 6 rotationally drives the first toner conveyance screw 5 (in response to toner supply signal) by the number of times proportional to the amount by which toner is to be supplied, whereas the second driving means 11 rotationally drives the second toner conveyance screw 10 continuously regardless of the amount by which toner is to be supplied.

The developing apparatus 100 is removably attached to the image forming apparatus main assembly, being enabled to move relative to the main assembly of the toner supplying apparatus 30. More specifically, the toner reception hole 105*a* of the developing apparatus 100 is connected to the above-mentioned second toner discharge hole 9 of the toner supplying apparatus 30. Among the above-listed structural components, only the developing apparatus 100 is a replaceable component (exchangeable unit) that can be removably mountable in the image forming apparatus main assembly, that is, removably attachable to the main assembly of the toner supplying apparatus. The other components are non-replaceable structural components of the main assembly of the image forming apparatus.

The main chamber 1 stores the toner filled therein by a user or such an operator as the maintenance person of the apparatus, from a toner supply unit (unshown), or the like, removably attachable to the apparatus main assembly. The main chamber 1 contains a stirring member (unshown), which sends toner to the buffer chamber 2, as necessary, while stirring the toner to prevent the toner from agglomerating. The bottom end of the buffer chamber 2 is connected to the first pipe 3, which is provided with the toner discharge outlet 4, which is located near the tip of the first pipe 3, being open vertically downward, and through which the toner is let fall. The first pipe 3 is virtually horizontally extended from the buffer chamber 2 of the toner supply container 20.

Within the pipe 3, the toner conveyance screw 5 is rotatably supported. As the first toner conveyance screw 5 is rotated, the toner in the first pipe 3 is advanced in the direction in which the spiral flange of the first toner conveyance screw 5 appears to advance as the screw 5 is rotated. More specifically, the first drive controlling means 7 controls the first driving means 6 in order to convey the toner toward the first toner discharge hole 4, or stop the first toner conveyance screw 5 to stop the toner conveyance. As the toner reaches the toner discharge hole 4, it falls virtually in its entirety through the toner discharge hole 4 due to its own weight, into the second pipe 8. The second pipe 8 is roughly horizontally extended from a location below the first toner discharge hole 4. It is provided with a second toner discharge hole 9 through which toner falls due to its own weight, and which is open straight downward.

The toner supply amount computing means 14 determines the amount by which toner is to be supplied to the developing apparatus 100, based on the values of the outputs of the sensor for detecting the ratio of the toner in the developer, and data such as print density and cumulative amount of the supplied toner, stored in the storage device 15. Then, based on the determined amount, the toner amount computing means 14 outputs to the first drive controlling means 7, the number of times, or length of time, the toner conveyance screw 5 needs to be rotated. As a result, the toner conveyance screw 5 is rotationally driven the necessary number of times, or length of time, conveying thereby the toner to cause the toner to fall into the second pipe 8 through the first toner discharge hole 4.

Figure 2:
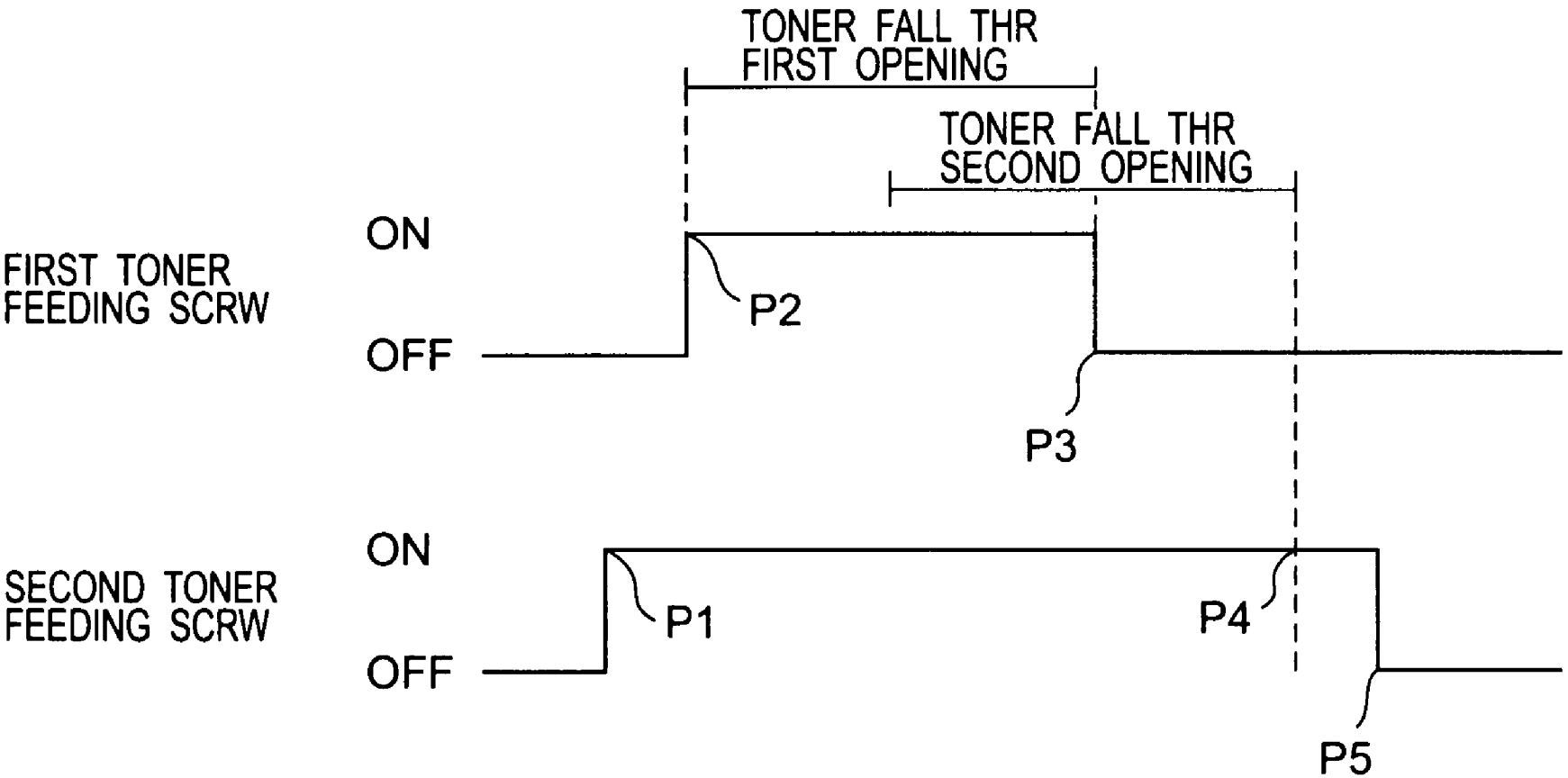
FIG. 2 is a timing chart for describing the toner supplying operation in accordance with the present invention.

The second toner conveyance screw 10 rotates or stops as the second drive controlling means 12 controls the second driving means 11. Referring to FIG. 2, the timing with which the rotation of the second toner conveyance screw 10 is started is set by the second drive controlling means 12 so that the rotation of the second toner conveyance screw 10 is started no later than when toner begins to be dropped into the second pipe 8 through the first toner discharge hole 4, by the rotation of the first toner conveyance screw 5 caused by the first driving means 7. On the other hand, the timing with which the rotation of the second toner conveyance screw 10 is stopped is set by the second drive controlling means 12 so that the second toner conveyance screw 10 is stopped no earlier than the point in time at which virtually the entirety of the toner in the second pipe 8 is dropped into the toner reception hole 105*a* of the developing apparatus 100 through the second toner discharge hole 9, by the rotation of the toner conveyance screw 10 caused by the second driving means 12.

In other words, the above-described first and second toner conveyance screws 5 and 10 are driven following the above-described control (driving or stopping) sequence, assuring thereby that the amount of the toner which is to be supplied to the developing apparatus 100 is caused by the first toner conveyance screw 5 to fall virtually in its entirety into the second pipe 8 through the first toner discharge hole 4, and then, is conveyed virtually in its entirety by the second toner conveyance screw 10 to the second toner discharge hole 9, through which it falls into the toner reception hole 105*a* of the developing apparatus 100. In other words, it is preferable that the second toner conveyance screw 10 is continuously driven so that the amount of the toner remaining in the second pipe 8 becomes virtually zero.

According to the toner supplying method in this embodiment, toner is dropped into the second pipe 8 by the first toner conveyance screw 5 by virtually the exact amount by which toner is to be supplied to the developing apparatus 100, and then, is conveyed in its entirety by the second toner conveyance screw 10 to the location of the toner reception hole 105*a* of the developing apparatus 100. While toner is conveyed through the second pipe 8, it sometimes adheres to the internal surface of the second pipe 8 and the surface of the toner conveyance screw 10 by a small amount.

However, the amount of the toner which adheres to the internal surface of the second pipe 8 and the surface of the toner conveyance screw 10 is negligibly small. Therefore, this adhesion of a small amount of toner does not create a serious problem in terms of the toner supplying performance of the toner supplying apparatus, even though toner is not supplied to the developing apparatus 100 by 100% of the amount by which toner is dropped into the second pipe 8 by the first toner conveyance screw 5.

Further, as described above, the rotation of the second toner conveyance screw 10 is stopped after virtually the entirety of the toner dropped into the second pipe is dropped from the second pipe 8 into the developing apparatus 100. Therefore, there is virtually no toner, except for the toner adhering to the internal wall of the second pipe 8, in the adjacencies of the second toner discharge hole 9. Therefore, even if the developing apparatus 100 in the form of an replaceable unit removable relative to the apparatus main assembly, vibrates when mounting or dismounting the developing apparatus 100, virtually no toner scatters. Thus, when appearance is not a major concern, or appearance does not matter, it is unnecessary to provide the toner discharge hole 9 and toner reception hole 105*a* with a complicated shutter mechanism. Further, if appearance is a major concern, only the second toner discharge hole 9 has to be provided with a mechanism for sealing or unsealing the second toner discharge hole 9, because the addition of the shutter mechanism for the toner discharge hole 9 is sufficient to make the image forming apparatus in this embodiment less likely to scatter toner than an image forming apparatus in accordance with the prior art having more complicated shutter mechanisms. As for the choice of the shutter, it may be such a shutter that is mechanically connected to the developing apparatus 100 as a removably mountable unit so that as the developing apparatus 100 is mounted or removed, the shutter unseals or seals, respectively, the second toner discharge hole 9. According to the present invention, the choice of the shutter is optional; any shutter may be employed as long as long it is capable of sealing or unsealing the second toner discharge hole 9. Since the shutter mechanisms of this type are well known in the field of this business, it will not be described in more detail.

In this embodiment, the toner supplying operation is controlled as shown in FIG. 2. That is, after the rotation of the second toner conveyance screw 10 is started (P1), the rotation of the first toner conveyance screw 5 is started (P2), starting thereby dropping toner through the first toner discharge hole 4. Then, after the rotation of the first toner conveyance screw 5 is stopped (P3), and the falling of the toner through the second toner discharge hole 9 completely stops (P4), the rotation of the second toner conveyance screw 10 is stopped (P5).

However, even if the rotation of the first toner conveyance screw 5 is started slightly before the rotation of the second toner conveyance screw 10 is started, there will be no problem in practical terms as long as toner is conveyed by the second toner conveyance screw 10 without permanently stagnating, although it may temporarily stagnate.

To elaborate, even if the relationship between the rotations of the first and second toner conveyance screws 5 and 10, in terms of the timing with which they are started or stopped, is not as ideal as shown in FIG. 2, in other words, even if the timing with which the rotation of the first toner conveyance screw 5 is started or stopped is the same as, or slightly earlier or later than, the timing with which the rotation of the second toner conveyance screw 10 is started or stopped, respectively, toner does not permanently stagnate, as long as the second toner conveyance screw 10 is superior to the first toner conveyance screw 5 in terms of toner conveyance performance. In other words, as long as the delay is within the tolerance regarding the performance of the developing apparatus 100, effects similar to those obtained when the timings are ideal can be obtained.

As described above, even if the chronological relationship between the timings with which the first and second toner conveyance screws 5 and 10 are stopped is not as ideal as shown in FIG. 2, as long as the second toner conveyance screw 10 exceeds in toner conveyance performance the first toner conveyance screw 5, toner is supplied to the developing device without permanently stagnating, although there will be a slightly delay in toner delivery compared to when the relationship is ideal.

In other words, all that is necessary is that the second driving means 11 for driving the second toner conveyance screw 10 is controlled by the second drive controlling means 12 so that the following inequality is satisfied: $N2 \times T2 > N1 \times T1$, wherein N1 stands for the amount by which toner is conveyed per driving of the first toner conveyance screw 5 by the first driving means 6 (amount of toner conveyed per rotation of screw, or per unit of time); T1 stands for the number times the toner conveyance screw 5 is driven by the first driving means 6 (number of revolution, or length of rotation); N2 stands for the amount by which toner is conveyed per driving of the second toner conveyance screw 10 by the second driving means 11 (amount of toner conveyed per rotation of screw, or per unit of time); T2 stands for the number times the toner conveyance screw 10 is driven by the second driving means 11 (number of revolution, or length of rotation).

In this case, such a measure as using each driving force source to drive multiple components may be taken. For example, the toner conveyance screw 10 may be driven by the driving force source which drives the development screw 103 and stirring screw 104 for conveying developer in the developing apparatus 100, or the development sleeve 101. In reality, the toner conveyance screw 10 may be always driven while the developing apparatus 100 is in action.

As described above, in the case of a toner supplying apparatus in accordance with the prior art, the two functions of conveying and measuring are performed by a single member, or the toner conveying member. In comparison, the toner supplying portion of an image forming apparatus in this embodiment is provided with the first toner conveying member (first toner conveyance screw 5) which functions as a metering device as well as a conveying device, and the second toner conveying member (second toner conveyance screw) which functions simply as a conveying device.

In the case of the toner supplying apparatus in this embodiment, therefore, the state in which virtually no toner is present in the adjacencies of the second toner discharge hole 9, through which toner is supplied to the developing apparatus 100, is realized by the functions of the first and second toner conveying members 5 and 10, reducing as much as possible the toner leakage and scattering which occur at the junction between the second toner discharge hole 9 of the toner supplying apparatus 30 and the toner reception hole 105*a* of the developing apparatus 100 (development unit) removably mountable in the main assembly of an image forming apparatus.

Also in the case of the toner supplying apparatus in this embodiment, even if toner is delivered in a short time by the first toner conveying member (first toner conveyance screw 5) from the first pipe 3 to the second pipe 8 in which the second toner conveying member (second toner conveyance screw 10) is present, the body of the toner having fallen from the first pipe 3 does not remain in the same state as that in which it was immediately after it fell from the first pipe 3. That is, while it is conveyed by the second toner conveying member (second toner conveyance screw 10) through the pipe 8, it gradually loosens, disintegrates, and levels, being therefore continuously dropped into the developing apparatus 100 little by little. In other words, even if toner is delivered in a very short time by the first toner conveying member (first toner conveyance screw 5) from the first pipe 3 to the second pipe 8 in which the second toner conveying member (second toner conveyance screw 10) is present, when it is delivered by the second toner conveying member 10 (second toner conveyance screw) from the pipe 8 to the developing apparatus 100, it is delivered in a continuous flow at a constant rate into the stirring chamber 105*c* of the developing apparatus 100. Therefore, it is possible to reduce as much as possible the possibility that the toner content in the developing apparatus 100 become locally high.

The first and second toner conveyance passages, and the first and second toner conveying members, may be of a single piece, or multiple pieces, as long as they are capable of efficiently performing the above described functions, while minimizing the developer leakage and developer scattering which occur at the junction between the toner discharge hole through which toner is delivered (dropped) and the toner reception hole on the side which is to be supplied with toner.

In this embodiment, the toner conveying members are in the form of a screw. However, this embodiment is not intended to limit the scope of the present invention in terms of the toner conveying means. In other words, the first or second toner conveying member, or both, may be in the form of something other than a screw, as long as they can efficiently convey toner. For example, even when they are in the form of a belt or the like, the effect of the present invention will be the same as those obtained when they in the form of a screw.

Also in this embodiment, the first and second toner conveyance passages as the first and second toner chambers are in the form of a pipe. However, this embodiment is not intended to limit the present invention in terms of the configuration of the first and second toner conveyance passages. For example, the first or second toner conveyance passages, or both, may be in the form of something other than a pipe.

Figure 4:
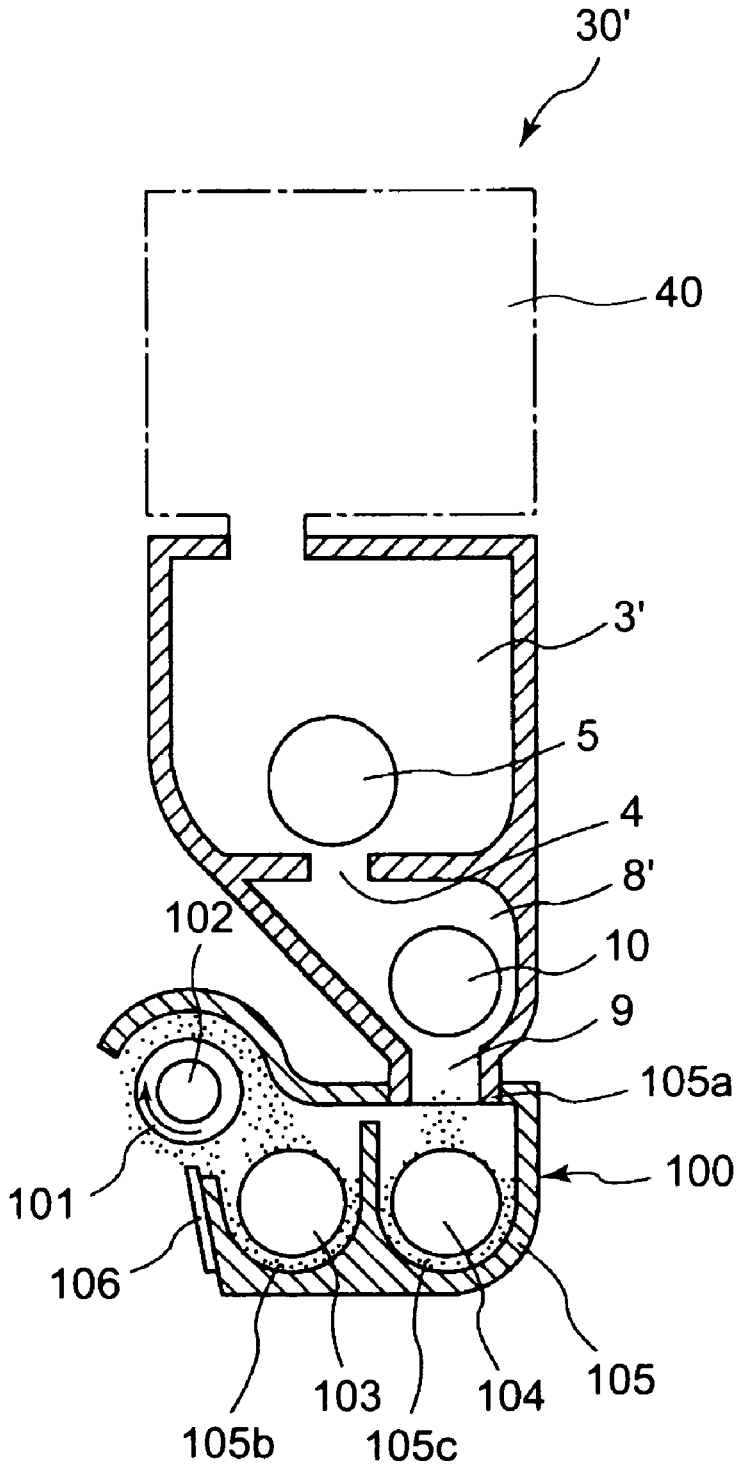
FIG. 4 is a schematic sectional view of the toner supplying apparatus in another embodiment of the present invention.
Figure 5:
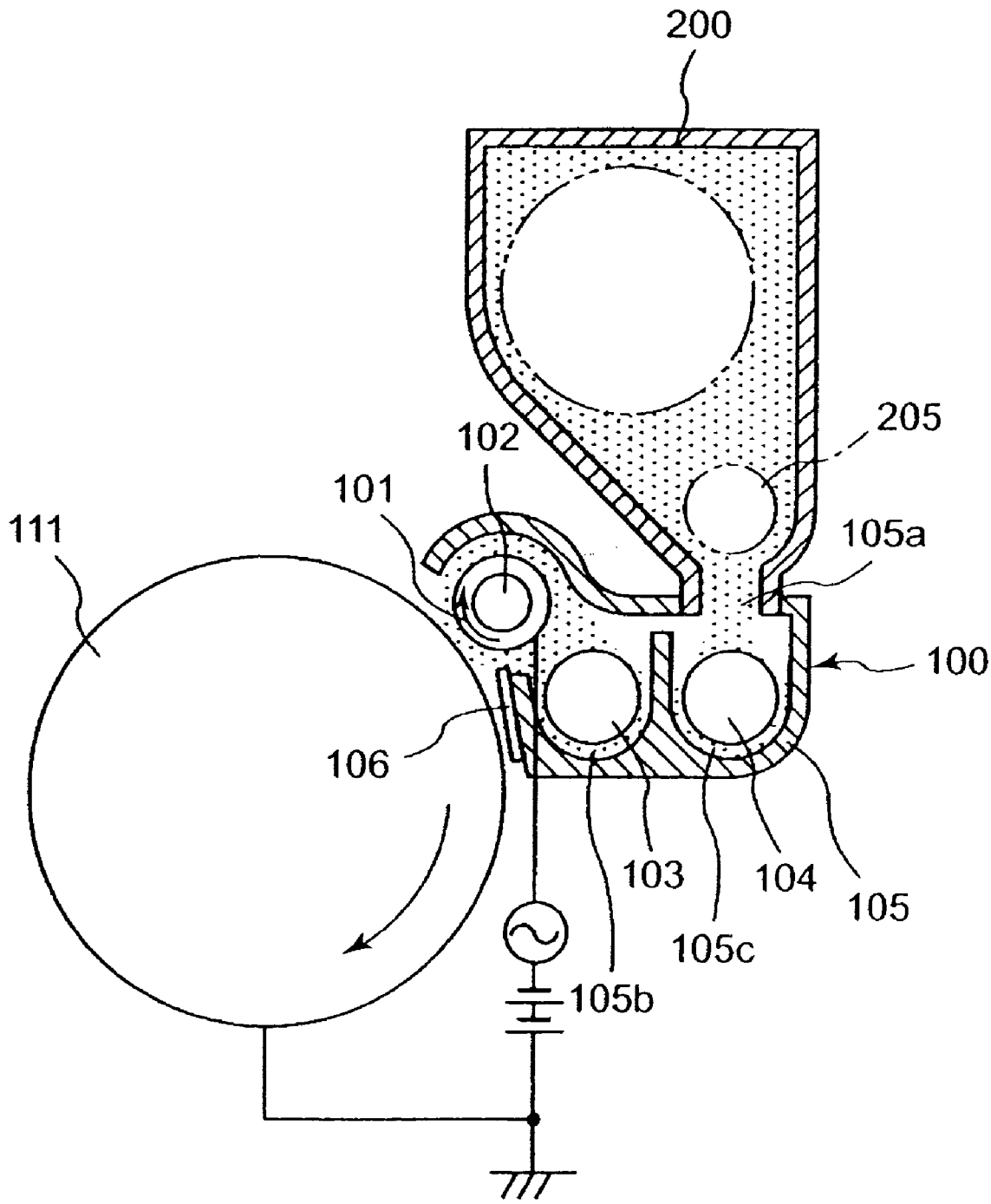
FIG.5 PRIOR ART
FIG. 5 is a schematic sectional view of an example of a developing apparatus in accordance with the prior art.
Figure 6:
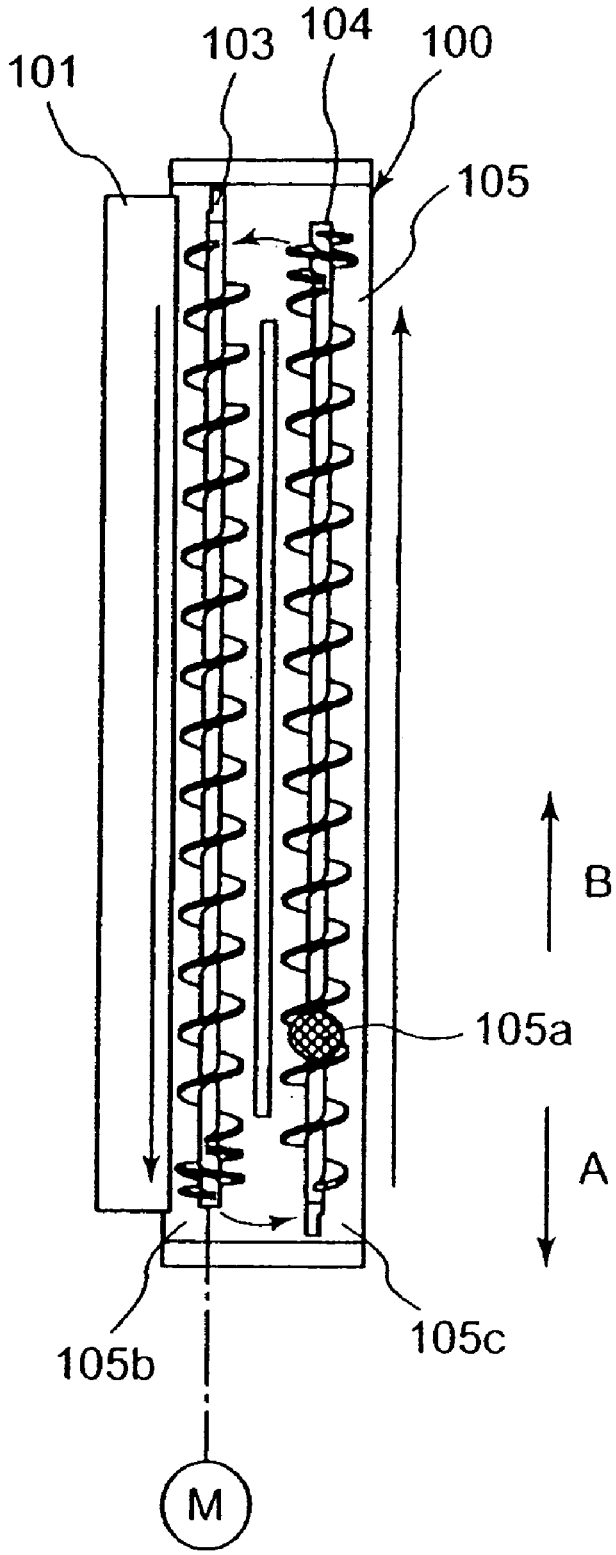
FIG. 6 PRIOR ART
FIG. 6 is a schematic plan view of an example of a developing apparatus in accordance with the prior art.
Figure 7:
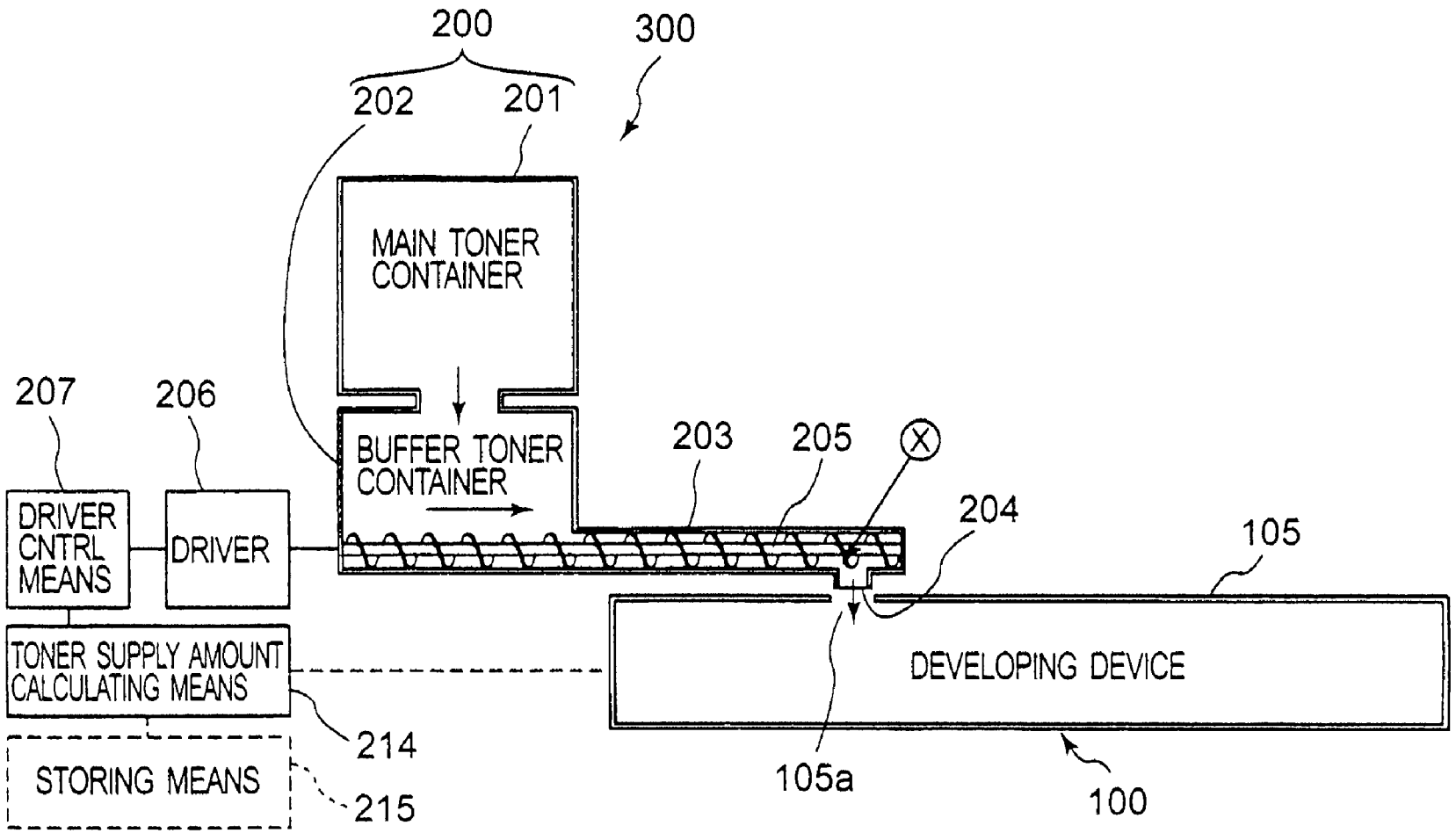
FIG.7 PRIOR ART
FIG. 7 is a schematic sectional view of an example of a toner supplying apparatus in accordance with the prior art.

For example, referring to FIG. 4, which shows a toner supplying container 30' comprising: a first toner chamber 3'; a first toner conveying member 5 for conveying the toner in the first toner chamber 3'; a second toner chamber 8' which receives the toner from the first toner chamber 3'; a second toner conveying member 10 for conveying the toner in the second toner chamber 8'; and a development unit 100 (developing means container 105) removably mountable in the image forming apparatus main assembly and having a third toner chamber which receives the toner discharged downward from the second toner chamber 8'. When supplying the development unit 100 with the use of this toner supplying apparatus 30', the first toner conveying member 5 is driven by the number of times, or length of time, proportional to the amount by which the development unit 100 is to be supplied with toner. Preferably, the second toner conveying member 10 is driven in connection with the conveying means 103 and 104 for conveying the toner in the development unit 100, or the development sleeve 101, so that the second toner conveying member 10 is continuously driven regardless of the amount by which the developing apparatus 100 is to be supplied with toner. With the employment of this mechanical arrangement, the problem that toner scatters due to the vibrations which occur when the development unit 100 is mounted into, or dismounted from, the image forming apparatus main assembly, does not occur. However, in order to be more sure that toner is prevented from scattering, the toner supplying apparatus 30' may be provided with a shutter for sealing or unsealing the toner discharge hole 9 of the second toner chamber 8'.

The first toner chamber 3' is equivalent to the first chamber of a toner hopper, that is the chamber into which toner is first delivered from the toner supplying unit 40 removably mountable in the image forming apparatus main assembly, or a toner cartridge itself removably mountable in the main assembly of an image forming apparatus. The second toner chamber 8' is equivalent to the second chamber of a toner hopper, that is, the chamber which receives toner from the first toner chamber 3', or a toner conveyance passage through which toner is conveyed from the first toner chamber 3' to the development unit 100.

Also in this embodiment, the subordinate apparatus or device (movable unit) which is to be supplied with particulate consumables, and which is movable relative to the main assembly of an apparatus, is a developing apparatus as a replaceable unit removably mountable in the main assembly of an image forming apparatus. However, this embodiment is not intended to limit the scope of the present invention in terms of an apparatus which is to be supplied with particulate consumables. In other words, the present invention is applicable to any apparatus (unit) employing a powder supplying apparatus having a powder reception hole, in order to prevent powder from scattering, and the effect which will be realized by such application will be similar to the effects in this embodiment. For example, the apparatus to be supplied with particulate consumables may be a process cartridge as a replaceable unit, which is removably mountable in the main assembly of an image forming apparatus. A process cartridge is such a cartridge in which an electrophotographic photosensitive member as an image bearing member, and at least one processing means among a charging means, a developing means, and a cleaning means, which act on the electrophotographic photosensitive member, are integrally disposed, and which is removably mountable in the main assembly of an image forming apparatus. In order for a process cartridge to be compatible with the present invention, a process cartridge must to be provided with a minimum of one toner reception hole similar to the above described ones. FIG. 3 shows an example of such a process cartridge, which comprises a frame (housing) formed ordinarily of plastic, and the combination of the photosensitive drum 111, developing apparatus 100, primary charging device 112, and a cleaning means 115, which are integrally disposed in the frame.

Also in this embodiment, toner is supplied from the toner supply container. However, this embodiment is not intended to limit the scope of the present invention in terms of the particulate consumables supplied by a powder supplying apparatus. For example, the particulate consumables supplied by a powder supplying apparatus may be two-component developer composed primarily of particulate toner and particulate carrier. Obviously, developer may contain a proper amount of ordinary external additive, or the like, for controlling the amount of charge, fluidity, etc., of developer. In other words, all that is necessary for the present invention to be applicable is that a powder supplying apparatus is structured so that it is capable of supplying at least toner.

In this specification, the expression that toner is conveyed or dropped virtually in entirety means that the actual amount of the toner conveyed and dropped into an apparatus which is to be supplied with particulate consumables is within the tolerance regarding the theoretical amount by which the apparatus is to be supplied with toner. In other words, it includes the case in which the amount of the toner which fails to be conveyed or dropped is within the tolerance regarding the above-described functions, or negligibly small.

Further, the expression that the amount by which toner is conveyed or dropped is practically proportional to the amount by which (number of times, or length of time) the toner conveying members are driven means that the amount by which toner is conveyed or dropped is quantitatively within the tolerance regarding the function of the toner supplying apparatus in terms of supplying toner to an apparatus which is to be supplied with particulate consumables. In other words, it includes the case in which the degree of nonproportionality between the amount by which toner is conveyed or dropped and the amount by which the toner conveying members are driven is negligibly small.

In other words, in the present invention, even if a minute amount of toner remains adhering to the internal surface of the second pipe 8 (second toner chamber), as long as the second toner conveyance screw 10 (second conveying member) is continuously driven for a length of time long enough for the toner received by the pipe 8 to be discharged in entirety toward the developing device (third toner chamber), it is assumed that the amount of the toner within the second toner chamber will become zero in a practical sense.

The following is another embodiment of the present invention.

Instead of placing the first pipe 3 above the second pipe 8 as described above, they may be integrated into a single straight pipe, which can be injection molded, and which comprises a first pipe (3) section, in which a first toner conveyance screw equivalent to the above-described first toner conveyance screw 5 is disposed, and a second pipe (8) section, in which a second toner conveyance screw is disposed. Also in this case, the rotations of the first and second toner conveyance screws are independently controlled as described above.

As described above, the above embodiments minimize the amount of the toner which remains in the adjacencies of the toner discharge hole of the second toner chamber, preventing thereby the problem that toner Scatters when the container having the third toner chamber is mounted or dismounted.

Further, even if a large amount of toner is delivered in a short time from the first toner chamber to the second toner chamber, the above-described embodiments prevent the toner content in the developing device from locally rising to an extreme level, preventing thereby the formation of an image in nonuniform in density.

While the invention has been described with reference to the structures disclosed herein, it is not confined to the details set forth, and this application is intended to cover such modifications or changes as may come within the purposes of the improvements or the scope of the following claims.

What is claimed is:

1. A toner supply apparatus comprising:

a first toner container for containing toner;

a first feeding member for feeding toner in said first toner container to discharge the toner through a first discharge opening provided in said first toner container;

a second toner container for receiving the toner discharged through said first discharge opening;

a second feeding member for feeding toner in said second toner container to discharge the toner through a second discharge opening provided in said second toner container;

a third toner container for receiving the toner discharged through said second discharge opening, wherein said third toner container is provided with a toner carrying member for carrying the toner to develop an electrostatic image on an image bearing member;

first drive control means for controlling said first feeding member so as to discharge an amount of the toner to be supplied to said third toner container; and second drive control means for controlling said second feeding member so that toner discharged through said first discharge opening is substantially not left in said second toner container.

2. An apparatus according to claim 1, further comprising feeding means, provided in said third toner container, for feeding the toner in said third toner container toward said toner carrying member, wherein said feeding means is driven in interrelation with said second feeding member.

3. An apparatus according to claim 2, wherein said carrying member is driven in interrelation with said second feeding member.

4. An apparatus according to claim 1, wherein said first toner container and said second toner container are tubular-shaped.

5. An apparatus according to claim 1, wherein said first feeding member and said second feeding member have a screw-like shape.

6. An apparatus according to claim 1, wherein while said first drive control means drive said first feeding member, wherein said second drive control means drives said second feeding member, and wherein after said first drive control means stops said first feeding member, said second drive control means stops said second feeding member.

* * * * *

UNITED STATES PATENT AND TRADEMARK OFFICE

CERTIFICATE OF CORRECTION

PATENT NO. : 7,110,707 B2
APPLICATION NO. : 10/847456
DATED : September 19, 2006
INVENTOR(S) : Hitoshi Nishitani It is certified that error appears in the above-identified patent and that said Letters Patent is hereby corrected as shown below:

COLUMN 2:
Line 24, (Close up the right margin.)
Line 25, (Close up the right margin.)

COLUMN 3:
Line 50, “above listed” should read --above-listed--.

COLUMN 8:
Line 1, “above” should read --above- --.
Line 17, “above described” should read --above-described--.

COLUMN 9:
Line 5, “such” should read --such as--.

COLUMN 10:
Line 62, “long” (second occurrence) should be deleted.

COLUMN 11:
Line 34, “performance” should read --performance of--.

COLUMN 12:
Line 46, “above described” should read --above-described--.
Line 60, “they” should read --they are--.

COLUMN 14:
Line 5, “above described” should read --above-described--.

COLUMN 15:
Line 4, “Scatters” should read --scatters--.
Line 1, “in” (first occurrence) should be deleted.

UNITED STATES PATENT AND TRADEMARK OFFICE

CERTIFICATE OF CORRECTION

PATENT NO. : 7,110,707 B2
APPLICATION NO. : 10/847456
DATED : September 19, 2006
INVENTOR(S) : Hitoshi Nishitani It is certified that error appears in the above-identified patent and that said Letters Patent is hereby corrected as shown below:

COLUMN 16:
Line 25, "drive" should read --drives--.
Line 26m, "wherein" should be deleted.

Signed and Sealed this

First Day of May, 2007

JON W. DUDAS
*Director of the United States Patent and Trademark Office*